United States Patent [19]

Meshulam

[11] 4,227,306

[45] Oct. 14, 1980

[54] UTILITY KNIFE WITH IMPROVED SAFETY FEATURE

[75] Inventor: Avram Meshulam, Edison, N.J.

[73] Assignee: CBS Inc., New York, N.Y.

[21] Appl. No.: 967,197

[22] Filed: Dec. 7, 1978

[51] Int. Cl.[3] ..... B25G 3/00

[52] U.S. Cl. ..... 30/342; 30/335; 30/339

[58] Field of Search ..... 30/342, 337, 339, 335

[56] References Cited

U.S. PATENT DOCUMENTS

| | | | |
|---|---|---|---|
| 526,290 | 9/1894 | Buckland | 30/342 |
| 526,293 | 9/1894 | Buckland | 30/342 |
| 1,800,254 | 4/1931 | Holmes | 30/342 |
| 2,464,408 | 3/1949 | Lightburn | 30/337 |
| 2,651,108 | 9/1953 | Weems | 30/337 |
| 3,621,570 | 11/1971 | Kolde et al. | 30/335 |

FOREIGN PATENT DOCUMENTS

| | | | |
|---|---|---|---|
| 555749 | 7/1923 | France | 30/342 |

*Primary Examiner*—Othell M. Simpson
*Assistant Examiner*—J. T. Zatarga
*Attorney, Agent, or Firm*—Spencer E. Olson; Martin M. Novack

[57] ABSTRACT

The disclosure is directed to a utility knife which is suitable for mounting at least two different types of blades and which has an improved safety feature. The knife of the invention has an elongated handle, and means for mounting a blade of one type at an end of the handle. In accordance with an important feature of the invention, the mounting means includes means for preventing the mounting of a blade at a given end of the handle when a blade is already mounted at the opposing end of the handle. In particular, in an embodiment of the invention the handle includes a pair of elongated mateable handle elements which conform generally in shape. A pair of blade-engaging units, each of which may be, for example, a suitably sized key or nub, are respectively disposed near the opposing ends of one of the handle elements. A blade-securing pad is disposed near one (only) end of the other handle element. Means are provided for removably mating the handle elements with a blade mounted in one of the blade-engaging units. In this manner, the securing pad secures the blade against the engaging unit, and the absence of a securing pad at the other end prevents another blade from being secured at the other end. In a further embodiment of the invention, an obstruction is mounted at the other end of the other handle element, and insures against a blade being secured at said other end of said other handle element.

20 Claims, 7 Drawing Figures

UTILITY KNIFE WITH IMPROVED SAFETY FEATURE

BACKGROUND OF THE INVENTION

This invention relates to utility knives and, more particularly, a utility knife having an improved safety feature.

Many types of knives having readily changeable blades have been developed in the past. Representative prior art utility knives are disclosed in the following U.S. patents:

U.S. Pat. Nos. 971,257; 1,616,040; 1,877,827; 2,131,358; 2,651,108; 2,679,100; 2,788,574; 2,862,296; 3,520,059.

In prior art configurations, including some of those set forth in this listing, provision is made for mounting blades of different types and/or sizes in a given knife and, to enhance this capability, the knife may have a blade-holding mount or chuck at both ends thereof. These mounts or chucks may have different configurations and/or sizes to receive different configurations and/or sizes of blades. It is desirable that the blades be readily and quickly changeable but, at the same time, the blade in use must be firmly and securely mounted in the knife. A further consideration is that the knife mechanism not be unduly complex or expensive to manufacture.

In the type of knife wherein blades are mountable at either end, a further important consideration is safety. If a user inadvertently or intentionally mounts blades at both ends of the knife, a severe safety hazard arises. A knife with exposed blades at both ends (for example, blades of two different types) may save a moment in switching blades, but could easily cause the accidental cutting of the user or a subsequent user who does not initially realize that blades are mounted at both ends of the knife.

It is an object of the present invention to devise a utility knife which has the flexibility of allowing blades to be mounted at either end thereof using uncomplicated and reliable mounts, while providing an important safety feature which prevents the simultaneous mounting of blades at both ends of the knife.

SUMMARY OF THE INVENTION

The present invention is directed to a utility knife which is suitable for mounting at least two different types of blades and which has an improved safety feature. The knife of the invention has an elongated handle, and means for mounting a blade of one type at an end of the handle. In accordance with an important feature of the invention, the mounting means includes means for preventing the mounting of a blade at a given end of the handle when a blade is already mounted at the opposing end of the handle. In particular, in an embodiment of the invention the handle includes a pair of elongated mateable handle elements which conform generally in shape. A pair of blade-engaging units, each of which may be, for example, a suitably sized key or nub, are respectively disposed near the opposing ends of one of the handle elements. A blade-securing means is disposed near one end of the other handle element. Means are provided for removably mating the handle elements with a blade mounted in one of the blade-engaging units. In this manner, the securing means secures the blade against the engaging unit, and the absence of a securing means at the other end prevents another blade from being secured at the other end. In a further embodiment of the invention, an obstruction is mounted at the other end of the other handle element, and insures against a blade being secured at said other end of said other handle element.

In the preferred form of the invention, the means for removably mating the handle elements comprises a pivot element which allows a user to rotate the handle elements between two opposing aligned orientations. Accordingly, the blade-securing means can be reversed to an opposite end of the handle formed by the handle elements. In this embodiment the blade engaging units comprise different blade-engaging keys, and the two different types of blades respectively have keyways which match the keys.

Further features and advantages of the invention will become more readily apparent from the following detailed description when taken in conjunction with the accompanying drawings.

DESCRIPTION OF THE PREFERRED EMBODIMENT

Referring to the FIGS. 1–4, there is shown an embodiment of a utility knife 10 which is suitable for mounting different types of blades at one or the other of the respective opposing ends thereof, and which has an improved safety feature in accordance with the invention. A handle 20 includes a pair of elongated mateable handle elements 30 and 40, which may typically be formed of a lightweight metal or of a rigid plastic.

Figure 1:
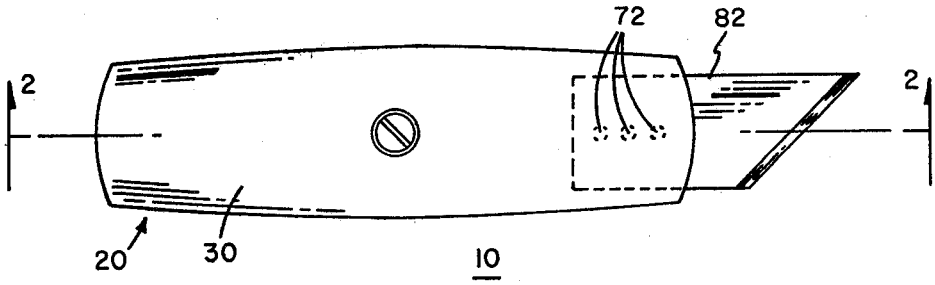
FIG. 1 is a side view of a utility knife in accordance with an embodiment of the present invention, showing a blade as being mounted at one end thereof, the portion of the blade within the handle being shown in phantom.
Figure 2:
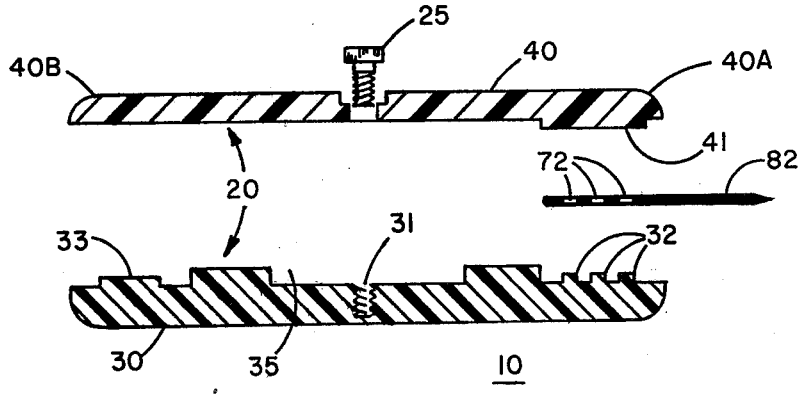
FIG. 2 is an exploded cross-sectional view as taken through a section defined by arrows 2—2 of FIG. 1.
Figure 3:
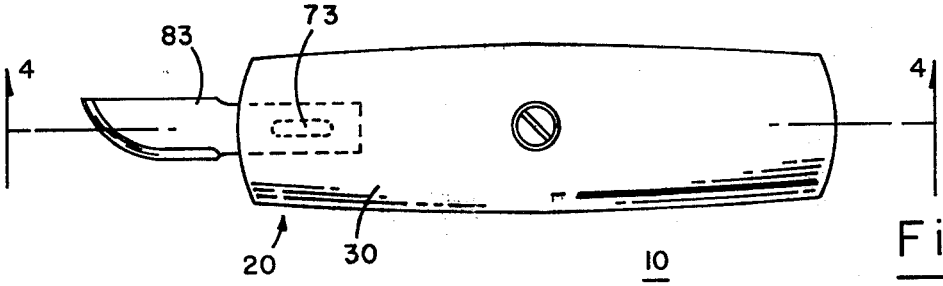
FIG. 3 is another side view of a utility knife in accordance with an embodiment of the invention, but with a blade being mounted at the opposite end thereof, the portion of the blade within the handle being shown in phantom.
Figure 4:
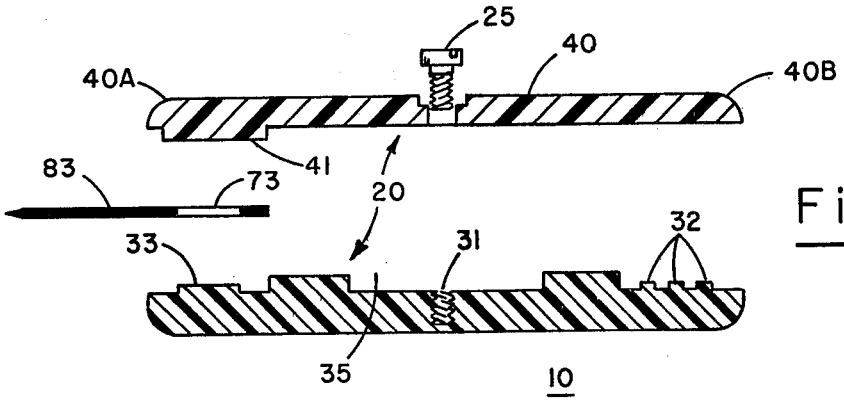
FIG. 4 is an exploded cross-sectional view as taken through a section defined by arrows 4—4 of FIG. 3.

The handle elements 30 and 40 can be mated in either of two opposing aligned orientations; viz. the orientation shown in FIGS. 1 and 2, or the orientation shown in FIGS. 3 and 4 where one of the handle elements (40) has been rotated 180°. The mated elements are fastened together by a screw 25 which engages suitable threading in a hole in handle element 30. The head of screw 25 engages a threaded seat 31 in handle element 30, the threaded seat 31 being countersunk in element 30 at a position which is in registration with the threaded hole in element 40.

One of the handle elements, 30, has a pair of blade-engaging units 32 and 33, one near each end thereof. In the present embodiment, the blade-engaging units 32 and 33 respectively comprise a pair of different keys. The key 32 may be, for example, of the conventional type which consists of two or more linearly arranged cylindrical nubs, these nubs being proportioned to receive and engage aligned circular keyway holes 72 in a conventional utility knife blade 82. In the present embodiment the other blade-engaging unit, 33, comprises a different type of key, for example a single elongated nub or flange. This key 33 engages a keyway or slot 73 in another type of utility knife blade 83, such as is shown in FIGS. 3 and 4. Each of the keys 32 and 33 are formed in recesses at the ends of handle element 30.

The handle element 40 has a blade-securing means 41 disposed near one end, 40A, thereof. This blade-securing means 41 may comprise, for example, a pressure pad which is proportioned to fit in one or the other of the end recesses of handle element 30. The pad 41 secures a blade against its corresponding key and exerts pressure thereon so as to hold the blade in a suitably rigid fashion. The other end, 40B, of handle element 40 has no pressure pad, and accordingly leaves a space or gap between itself and the particular key which it faces. The pressure pad 41 is typically, although not necessarily, formed integrally with handle element 40B.

In preparing the unit for use, the screw 25 is loosened and the desired blade (e.g. blade 82—FIGS. 1 and 2) is engaged with its matching key of handle element 30. The handle element 40 is mated with element 30 by aligning the two elements with the blade-securing pad 41 facing the selected key (32). The screw 25 is then tightened to firmly secure the blade in position. If one attempted to also engage a second blade with a key at the other end of handle element 30, the absence of a securing pad would render the second blade so loose as to cause it to fall from the knife, or at least alert the user that it should be stored. When it is desired to mount a blade of a different type (for example blade 83), the screw 25 is loosened and the blade is engaged with the other keyway 33. The handle element 40 is rotated 180° so that the pad 41 opposes keyway 33. The screw 25 is then tightened to obtain the configuration of FIG. 4. A central recess 35 in handle element 30 can be used to store spare blades.

Figure 5:
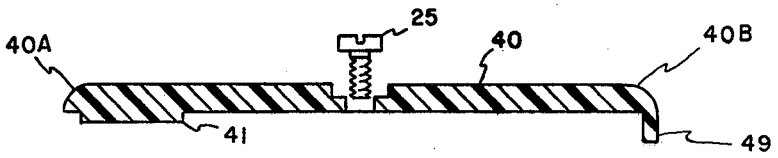
FIG. 5 is a cross-sectional view of an alternate form of the handle element 40 of FIGS. 1–4.

In FIG. 5 there is shown a variation of the embodiment shown in FIGS. 1–4, wherein an obstruction 49 (typically, although not necessarily, formed integrally with the handle element 40) is mounted at the end 40B of handle element 40. This obstruction further insures that a second blade is not mounted or engaged at the end of the knife which is opposite to the pad 41.

Figure 6:
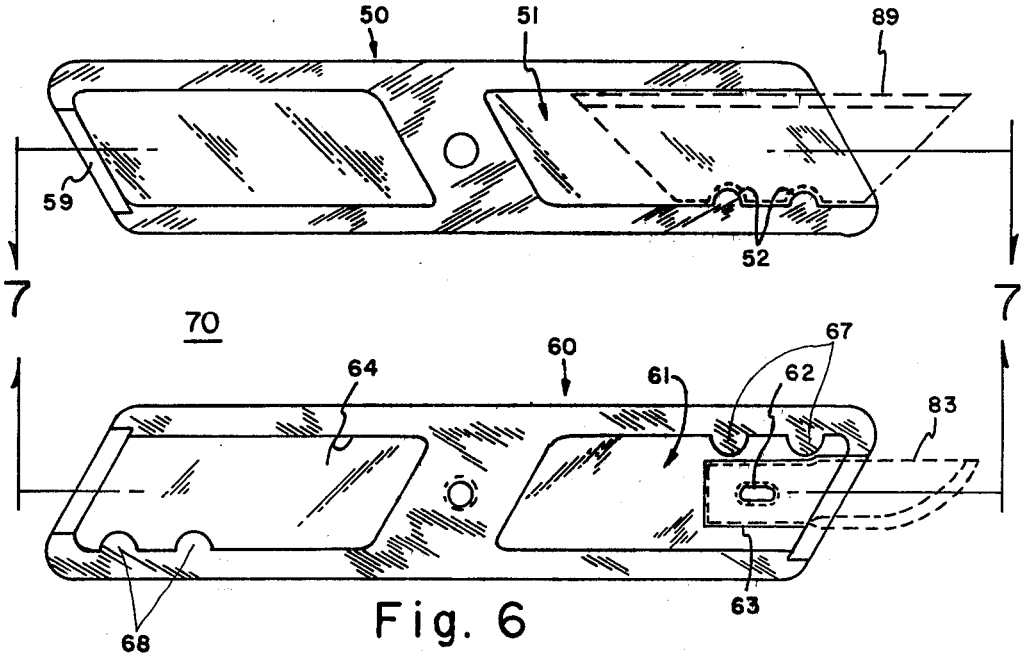
FIG. 6 is a planned view of the utility knife in accordance with another embodiment of the invention.
Figure 7:
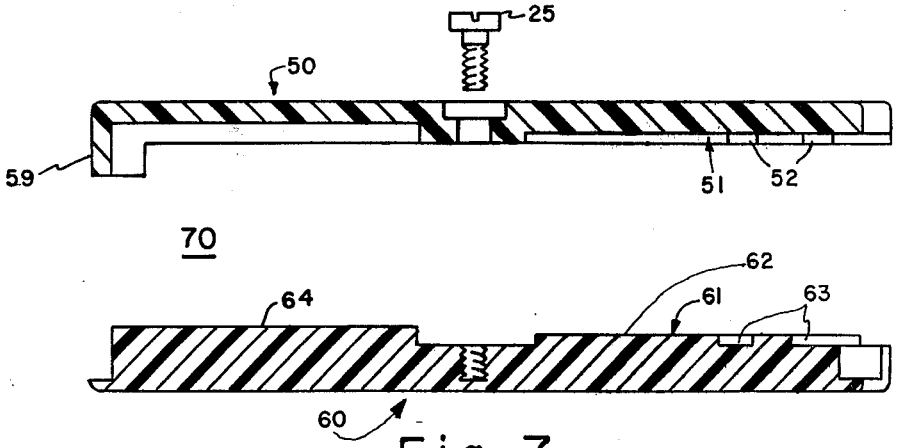
FIG. 7 is a cross-sectional view of the utility knife of FIG. 6.

Referring to FIGS. 6 and 7, there is shown a further embodiment of the invention wherein a handle 70 includes a pair of elongated mateable handle elements 50 and 60. Operation is similar to that of the previous embodiment, the mated elements being fastened together by a screw 25 which engages suitable threading in a hole in handle element 60. In the embodiment of FIGS. 6 and 7, the handle elements 50 and 60 have blade-engaging units 51 and 61 near respective ends thereof. In the present embodiment, the blade-engaging units 51 and 61 comprise a pair of different keys 52 and 62. The key elements 52 are formed in a recess in the handle element 50, whereas the key element 62 is formed in a recessed portion 63 of the blade-engaging unit 61, the surrounding portion of this unit being raised in the handle element 60. The opposing end of the handle element 50 has an obstruction 59 mounted thereon, this obstruction typically being integrally formed as part of the handle element 50. At the opposing end of the handle element 60 is a blade-securing pad 64, which comprises a raised area of the handle element 60.

In operation of the embodiment of FIGS. 6 and 7, the key 62 can engage a keyway or slot of a utility knife blade 83, the blade being fit in the recess 63 of the blade-engaging unit 61. With the handle element mated in the orientation shown in FIGS. 6 and 7, the blade-engaging unit 61, which is contoured, as shown at 67, to fit over key elements 52, mates into the blade-engaging unit 51 (i.e., the recess), and the blade 83 is secured firmly in place. To visualize the use of another type of blade, 89, the orientation of the handle element 60 is reversed, and the pad 64 mates into the recess 51 with the blade 89 in place, as shown. The blade 89 has keyway slots which engage the key 52 of blade-engaging unit 51. The pad 64, which is contoured, as shown at 68, to fit over key elements 52, holds the blade securely in place. In either orientation, the obstruction 59 prevents the mounting of a blade at the opposite end of the knife.

The invention has been described with reference to particular embodiment, but variations within the spirit and scope of the invention will appear to those skilled in the art. For example, it will be understood that provision could be made, if desired, for mounting three or more types of blades in the knife, so long as appropriate means, consistent with the invention, are utilized for preventing mounting of a blade at both ends of the knife. Further, it would be understood that alternate techniques could be employed for removably mating the handle element.

I claim:

1. A utility knife suitable for mounting at least two different types of blades and having an improved safety feature, comprising:

a handle which includes a pair of elongated mateable handle elements, one of said handle elements having a pair of blade-engaging units, one near each end thereof;

blade-securing means disposed near one end only of the other handle element; and means for removably mating said handle elements with a blade mounted in one of said blade-engaging units, whereby said blade-securing means secures said blade and the absence of a blade-securing means at the other end of said other handle element prevents securing of another blade at said other end.

2. The utility knife as defined by claim 1 wherein said means for removably mating said handle elements comprises a pivot element which allows rotation of said handle elements between two opposing aligned orientations, so that said blade-securing means can be reversed to an opposite end of the handle formed by said handle elements.

3. The utility knife as defined by claim 1 wherein said blade-engaging units are configured to receive different types of blades.

4. The utility knife as defined by claim 2 wherein said blade-engaging units are configured to receive different types of blades.

5. The utility knife as defined by claim 3 wherein said blade-engaging units comprise different blade-engaging keys and said two types of blades respectively have keyways which match said keys.

6. The utility knife as defined by claim 4 wherein said blade-engaging units comprise different blade-engaging keys and said two types of blades respectively have keyways which match said keys.

7. The utility knife as defined by claim 1, 2, 3 or 5 further comprising an obstruction mounted at the other end of said other handle element and further preventing the securing of a blade at said other end of said other handle element.

8. A utility knife having an improved safety feature, comprising:

first and second blades of different types;

a handle which includes a pair of elongated mateable handle elements, one of said handle elements having a pair of blade-engaging units, one near each end thereof;

blade-securing means disposed near one end only of the other handle element; and means for removably mating said handle elements with a blade mounted in one of said blade-engaging units, whereby said blade-securing means secures said blade and the absence of a blade-securing means at the other end of said other handle element prevents securing of another blade at said other end.

9. The utility knife as defined by claim 8 wherein said means for removably mating said handle elements comprises a pivot element which allows rotation of said handle elements between two opposing aligned orientations, so that said blade-securing means can be reversed to an opposite end of the handle formed by said handle elements.

10. The utility knife as defined by claim 8 wherein said blade-engaging units are configured to receive different types of blades.

11. The utility knife as defined by claim 9 wherein said blade-engaging units are configured to receive different types of blades.

12. The utility knife as defined by claim 10 wherein said blade-engaging units comprise different blade-engaging keys and said two types of blades respectively have keyways which match said keys.

13. The utility knife as defined by claim 11 wherein said blade-engaging units comprise different blade-engaging keys and said two types of blades respectively have keyways which match said keys.

14. The utility knife as defined by claim 8, 9, 10 or 12 further comprising an obstruction mounted at the other end of said other handle element and further preventing the securing of a blade at said other end of said other handle element.

15. A utility knife suitable for mounting at least two different types of blades and having an improved safety feature, comprising:

a handle which includes a pair of elongated mateable handle elements, each of said handle elements having a blade-engaging unit at an end thereof;

blade-securing means at the other end of one of said handle elements;

an obstruction mounted at the other end of the other of said handle elements; and means for removably mating said handle elements with a blade mounted between the blade-engaging unit of said other handle element and either the blade-engaging unit or the blade-securing means of said one handle element, whereby the obstruction at the other end of said other handle element prevents securing of another blade at said other end.

16. The utility knife as defined by claim 15 wherein said different types of blades are configured to be secured either between said blade-engaging units or between the blade-engaging unit of said other handle element and the blade-securing means of said one handle element.

17. The utility knife as defined by claim 16 wherein said means for removably mating said handle elements comprises a pivot element which allows rotation of said handle elements between two opposing aligned orientation.

18. A utility knife having an improved safety feature, comprising:

first and second blades of different types;

a handle which includes a pair of elongated mateable handle elements, each of said handle elements having a blade engaging unit at an end thereof;

blade-securing means at the other end of one of said handle elements;

an obstruction mounted at the other end of the other of said handle elements; and means for removably mating said handle elements with a blade mounted between the blade-engaging unit of said other handle element and either the blade-engaging unit or the blade-securing means of said one handle element, whereby the obstruction at the other end of said other handle element prevents securing of another blade at said other end.

19. The utility knife as defined by claim 18 wherein said different types of blades are configured to be secured either between said blade-engaging units or between the blade-engaging unit of said other handle element and the blade-securing means of said one handle element.

20. The utility knife as defined by claim 19 wherein said means for removably mating said handle elements comprises a pivot element which allows rotation of said handle elements between two opposing aligned orientations.

* * * * *